United States Patent [19]

Luigi

[11] 4,314,789

[45] Feb. 9, 1982

[54] EQUIPMENT FOR LATERAL EXCAVATION

[76] Inventor: Accossato Luigi, Castelrotto Di Guarene, Regione Piove, Cuneo, Italy

[21] Appl. No.: 44,845

[22] Filed: Jun. 4, 1979

[30] Foreign Application Priority Data

Jun. 20, 1978 [IT] Italy ..... 68440 A/78

[51] Int. Cl.[3] ..... E02F 3/32

[52] U.S. Cl. ..... 414/694; 37/103; 414/705

[58] Field of Search ..... 37/103, 118 R; 414/694, 414/705

[56] References Cited

U.S. PATENT DOCUMENTS

| | | | |
|---|---|---|---|
| 3,283,928 | 11/1966 | De Bosredon | 414/694 |
| 3,515,298 | 6/1970 | Guinot | 414/694 |
| 4,077,140 | 3/1978 | Branconi | 37/103 |

FOREIGN PATENT DOCUMENTS

| | | | |
|---|---|---|---|
| 161879 | 3/1955 | Australia | 414/694 |
| 1634873 | 10/1970 | Fed. Rep. of Germany | 416/694 |
| 2113758 | 6/1972 | France | 37/103 |
| 464095 | 11/1968 | Switzerland | 37/103 |
| 1049307 | 11/1966 | United Kingdom | 414/694 |

*Primary Examiner*—Steven A. Bratlie

[57] ABSTRACT

Hydraulic excavator in which the support means for the bucket allows lateral excavation over considerable lengths. This means comprises: a fastening element solid with the excavator arm; a first and a second bearing structures hinged to each other as well as to the fastening element and to the bucket, respectively; a tie-rod connecting the second bearing structure to the fastening element; means for moving the first bearing structure with respect to the fastening element and the bucket with respect to the arm; and means for adjusting the angular position of the tie-rod with respect to the first bearing structure.

2 Claims, 4 Drawing Figures

EQUIPMENT FOR LATERAL EXCAVATION

The invention refers to hydraulic excavators provided with an equipment for the lateral excavation, mounted on the excavator manuever arm. More particularly, the invention refers to excavators of the type in which the manuever arm comprises a first arm element, hinged at its base on an anchor pivot carried by the excavator and parallel to the abutment surface of the excavator, and a second arm element hinged on the free end of the first element by means of an articulation pivot substantially parallel to the anchor pivot, the free end of that second element being provided with means supporting a bucket.

It is often necessary to carry out, by means of excavators of the above mentioned kind, an excavation extending on the ground so as to form a ditch, a canal or the like arranged by the side of the excavator, that is off-set from the line of movement of the excavator by a quantity greater than half the excavator width. In order to carry out easily that excavation, the digging bucket must be kept substantially parallel to itself over the whole excavation length.

According to the known technique, disclosed by French Pat. No. 2.346.506, the manuever arm is modified starting from the hinge between the adjacent ends of the two arm elements. That hinge is obtained in this case by replacing the conventional articulation pivot by a joint allowing a double mutual articulation of the adjacent ends of said arm elements. A good alignment of the bucket with respect to the excavation can thus be achieved, and the alignment can be maintained over a considerable excavation length without moving the excavator on the ground.

Yet according to this known technique the excavator can carry out excavations which are offset from the line of advancement of the excavator by a quantity which in practice cannot exceed the length of the first element of the manuever arm.

It is an object of the invention to provide an equipment for lateral excavation applicable to hydraulic excavators which allows, other conditions being unchanged, excavations more offset than those realizable by known excavators.

It is another object of the invention to provide an equipment for lateral excavation which can be mounted readily and by replacing a limited number of pieces, on the manuever arm of a conventional excavator.

To achieve these objects, the invention provides an equipment for lateral excavation by means of hydraulic excavators, of the above specified kind, characterized in that the means supporting the bucket comprises: a fastening element solid with the free end of the second element of the manuever arm; a first bearing structure hinged to the fastening element by a bearing pivot substantially parallel to the anchor pivot; a second bearing structure supported by the first one for rotation around a positioning pivot substantially perpendicular to said anchor pivot, said second structure having pivotally connected thereto, by a work pivot substantially parallel to the anchor pivot, the bottom end of the bucket; a tie-rod connecting a point of the second structure, laterally displaced with respect to the axis of the positioning pivot, with a point of the fastening element, means being provided for rotating the first structure around the bearing pivot, for varying the relative angular position of the tie-rod and the first bearing structure in any predetermined position thereof relative to the fastening element, and for rotating the bucket around the working pivot.

The bucket, being supported by the manuever arm through a double articulation, can take any orientation with respect to the manuever arm. The combined presence of the tie-rod, of the means for rotating the first structure and of the means for varying the angular position of the tie-rod with respect to the first structure allows the operator to control the position of the bucket relative to the arm. Thus the bucket can be oriented so as to take the position most suitable for the operator. This is particularly useful not only when a lateral excavation is to be effected, but also when slopes, banks or inclined walls are to be arranged or when ditches or the like are to be dredged.

The invention will now be described with reference to a preferred practical embodiment shown in the annexed drawings, given only by way of a non limitative example, in which.

Figure 1:
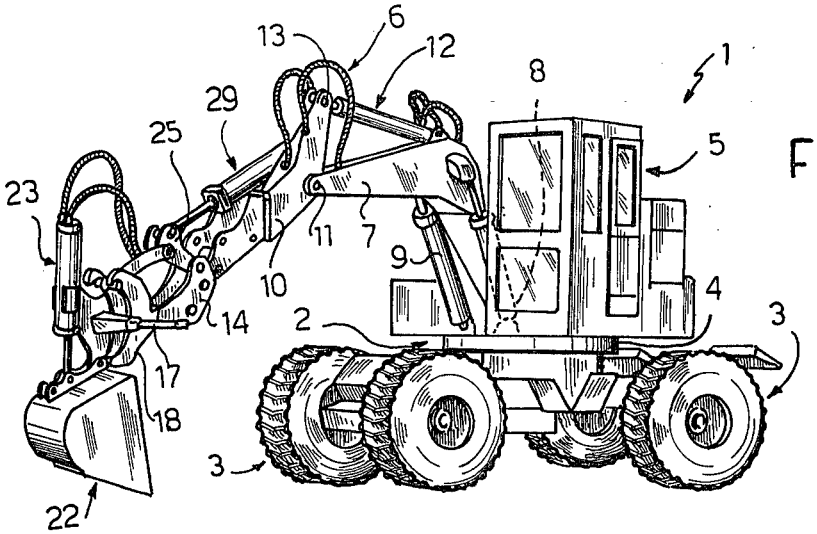
FIG. 1 is a perspective elevation of an excavator according to the invention.
Figure 2:
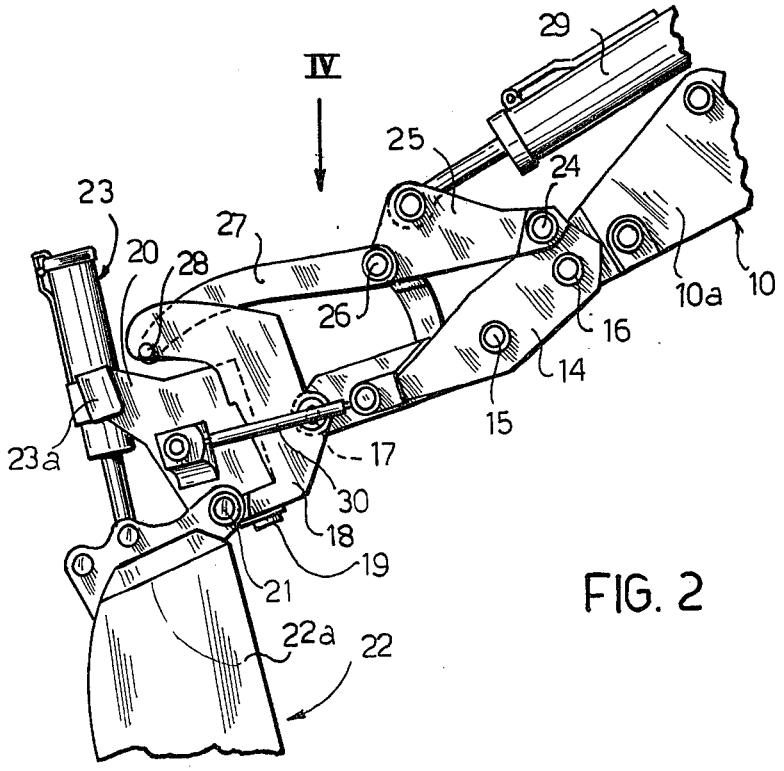
FIG. 2 is a view on enlarged scale of a detail of FIG. 1.
Figure 3:
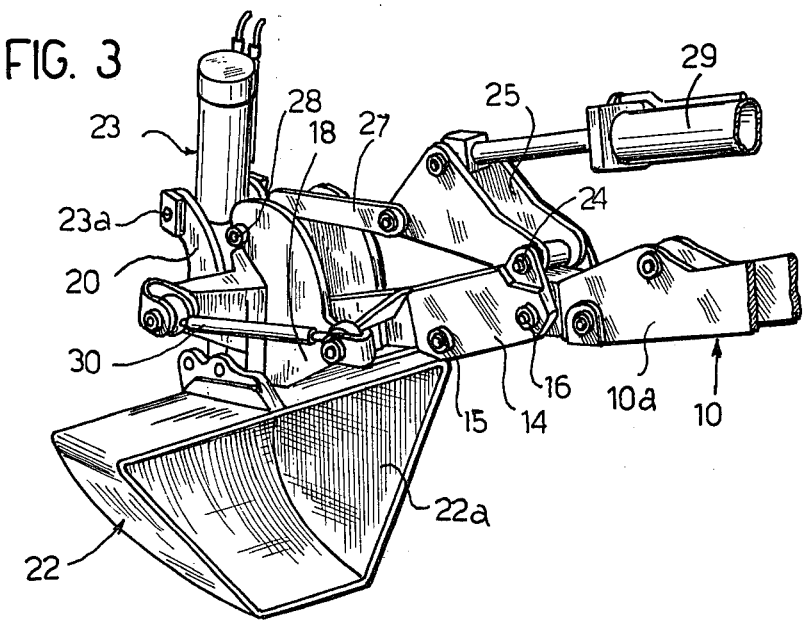
FIG. 3 is a perspective view of the detail shown in FIG. 2.
Figure 4:
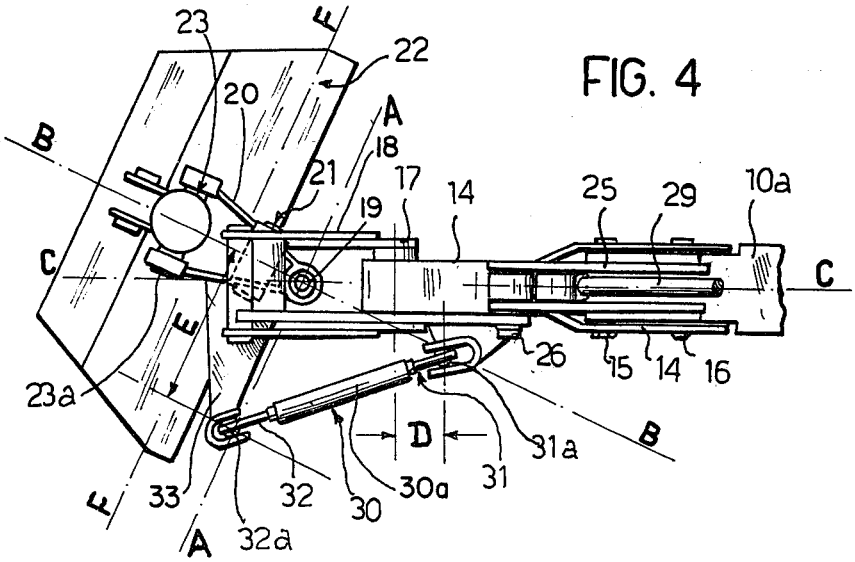
FIG. 4 is a view taken along arrow IV of FIG. 2.

Reference 1 denotes an hydraulic excavator in the whole. Excavator 1 comprises a structure 2 forming the frame and is equipped with wheels 3 for its movement. A platform 4 bearing a turret 5 with a manuever cabin for the operator manuvering the excavator is rotatably mounted on structure 2. The excavator 1 has moreover a manuever arm 6 comprising a first arm element 7. The first arm element is hinged at its base on an anchor pivot 8 carried by the rotating platform 4. The free end of arm element 7 bears an articulation pivot 11 on which a second arm element 10 is pivotally mounted. The movement of the first arm element 7 is driven by a jack 9 which is hinged at one end to the first arm element 7 and at the other end to the rotating platform 4. The movement of the second arm element 10 about articulation pivot 11 is driven by a jack 12 which is hinged at one end to arm element 7 and at the opposed end to an appendage 13 of arm element 10. A fastening element 14 is fixed to free end 10*a* of arm element 10 by means of a pair of pins 15 and 16. Element 14 bears at its free end a bearing pivot 17 on which a first bearing structure 18 is pivotally mounted. The bearing pivot 17, articulation pivot 11 and anchor pivot 8 are substantially parallel to one another. The first bearing structure 18 bears a positioning pivot 19, which is substantially perpendicular to bearing pivot 17 and on which a second bearing structure 20 is pivotally mounted. Structure 20 bears a working pivot 21, parallel to anchor pivot 8, and bottom end 22*a* of a bucket 22 is hinged on pivot 21. The oscillation of bucket 22 about working pivot 21 is driven by a jack 23 hinged on a pivot 23*a* borne by the second bearing structure 20. End 10*a* of the second arm element 10 bears a pivot 24 on which a crank 25 is mounted. The free end of crank 25 bears a pivot 26 on which one end of a connecting rod 27 is mounted, the other end of the connecting rod being hinged on a pivot 28 borne by structure 18. The oscillation of crank 25 about pivot 24 is driven by a jack 29 which is hinged at one end to the crank and at the other end to the second arm element 10. Reference 30 denotes a tie-rod formed by a tubular bushing 30*a* and two rods 31, 32 projecting from opposite ends of bushing 30*a*. The connection between rods 31, 32 and bushing 30*a* is obtained through a threaded portion of each of said rods meshing with the internal thread of the corresponding end of bushing 30*a*. Rod 31 is connected at a point 31*a*, through a ball joint, to fastening rod 14. End rod 32 is connected at a point 32*a*, through a ball joint, to an appendage 33 of the second bearing structure 20. Plane AA, passing through positioning pivot 19 and containing point 32*a*, is substantially perpendicular to central plane BB of bucket 22. The two elements 7, 10 of the manuever arm 6 are arranged so that their symmetry planes perpendicular to the axis of anchor pin 8 coincide, therefore defining a single plane shown at CC in FIG. 4. The latter plane contains the axis of positioning pivot 19. As shown by the same FIG. 4, points 31*a* and 32*a*, where the ends of tie-rod 30 are connected respectively to fastening element 14 and to bearing structure 20, are located on the same side with respect to plane CC. Moreover, distance D of point 31*a* from the axis of bearing pivot 17 is about one third of distance E of the axis of positioning pivot 19 from connection point 32*a*.

The operation of the excavator is as follows: excavator 1 is positioned by the side of the line along which the lateral excavation must occur. The operator, by acting on manuever arm 10, lays the bucket on the ground in correspondence of the excavation area. By acting on tubular bushing 30*a* of tie-rod 30, the length of the latter is adjusted and as a consequence the angular position of the bearing structure 20 about positioning pivot 19 is adjusted. Such position is varied until front face FF of bucket 22 is substantially perpendicular to the line of the lateral excavation. By acting then on jack 23, the excavation is started from the chosen point and is then continued by acting on the rotation of turret 5 and elements 7 and 10 of the manuever arm so as to displace the bucket along the excavation axis. By a suitable choice, at the design stage, of the position of pivot points 31*a* and 32*a* of the ends of tie-rod 30, during the operation it is possible to displace bucket 22 along the excavation line over a considerable length without moving front face FF of the bucket itself sensibly away from its position perpendicular to the excavation line. Thus a correct excavation can be achieved over a considerable length without need to change the position of excavator 1 along the movement line parallel to the excavation line. A suitable choice of the positions of points 31*a* and 32*a* allows an increase of such a length, which moreover can be kept considerable even when varying the distance between the excavation line and the line of movement of excavator 1 parallel to the excavation line. Since plane AA is perpendicular to plane BB, the position of bucket 22 is particularly affected by changes in the operating positions of jack 29 and therefore of the second bearing structure 20. Similarly, the ratio between distances E and D allows the enhancement of the dependence of the position of bucket 22 on the position of structure 20.

The above advantages can be increased by using a tie-rod consisting for instance of a hydraulic jack whose length can be adjusted by the operator. Obviously in this case the manuever control is more complex. As a compensation, the double articulation between the bucket and the manuever arm together with the possibility of varying at any moment the length of the tie-rod, allows an adjustment at will, within a very wide range, of the position of the bucket which therefore must take the position which is judged at that moment as the most suitable.

Obviously, keeping the basic principle of the invention unchanged, the practical embodiments and the constructive details can be modified with respect to what has been described and shown without departing from the scope of the present invention.

What I claim is:

1. Equipment for lateral digging, said equipment being applicable to hydraulic excavators provided with a manuever arm including a first arm element, hinged at its base on an anchor pivot carried by the excavator and parallel to the supporting surface thereof, and a second arm element hinged to the free end of the first arm element by an articulation pivot the axis of which is substantially parallel to the axis of the anchor pivot, the free end of said arm element being provided with means for supporting a bucket, characterized in that the means for supporting the bucket comprises:

a fastening element rigidly secured to the free end of the second arm element of the manuever arm a first bearing structure hingedly coupled to the fastening element by a bearing pivot having an axis that is substantially parallel to the axis of the anchor pivot, a rigid one-piece second bearing structure supported by the first bearing structure for rotation around a positioning pivot having an axis that is substantially perpendicular to the axis of said anchor pivot, the bottom end of the bucket being connected to said second bearing structure through a working pivot having an axis that is substantially parallel to the axis of the anchor point, a rigid tie-rod laterally displaced relatively to the axis of said positioning pivot and connecting said second bearing structure to the fastening element by means of ball joint elements, whereby the angle of the bucket is adapted to be corrected with respect to the first and second arm elements in a plane parallel to the supporting surface of the excavator to thereby correct the bucket angle in a plane perpendicular to the supporting surface of the excavator, said tie-rod including means for varying its length, said last-mentioned means comprising a first hydraulic jack and an operator actuated jack drive means for adjusting the position of the jack, the equipment further comprising crank assembly means for rotating the first bearing structure about the axis of the bearing pivot, said crank assembly means being formed by a connecting rod and a crank, and joining said structure with the fastening element, said connecting rod and the crank of said crank assembly means being respectively hinged to the first bearing structure and to the fastening element, and a second hydraulic jack having one end pivotally connected to the crank and the opposite end pivotally connected to the second element of the manuever arm, means for varying, in any predetermined position of the first bearing structure relative to the fastening element, the angular position of the tie-rod with respect to the first bearing structure, and means for rotating the bucket about the axis of the working pivot, the positioning pivot connecting the first and second bearing structures lying substantially in the plane containing the two elements of the manuever arm, the plane passing through the axis of the positioning pivot and containing the point connecting the tie-rod with the second bearing structure being substantially perpendicular to the central plane of the bucket, and the distance of the axis of the bearing pivot from the connection between the tie-rod and the fastening element being substantially one third of the distance of the axis of the positioning pivot from the connection of the tie-rod with the second structure.

2. Equipment according to claim 1, wherein the tie-rod is divided into two separate parts axially connected through a screw-female thread connection.

* * * * *